US008764116B2

(12) United States Patent
Weber et al.

(10) Patent No.: US 8,764,116 B2
(45) Date of Patent: Jul. 1, 2014

(54) ITEM OF SEATING FURNITURE

(75) Inventors: Reinhard Weber, Minden (DE); Thomas Braun, Tauberbischofsheim (DE); Walter Richter, Tauberbischofsheim (DE); John Harding, Tauberbischofsheim (DE)

(73) Assignee: VS Vereinigte Spezialmoebelfabriken GmbH & Co. KG, Tauberbischofsheim (DE)

( * ) Notice: Subject to any disclaimer, the term of this patent is extended or adjusted under 35 U.S.C. 154(b) by 300 days.

(21) Appl. No.: 12/793,721

(22) Filed: Jun. 4, 2010

(65) Prior Publication Data

US 2011/0221255 A1 Sep. 15, 2011

(30) Foreign Application Priority Data

Mar. 15, 2010 (DE) ..... 20 2010 003 608 U

(51) Int. Cl.
*A47C 9/00* (2006.01)
*A47C 16/02* (2006.01)

(52) U.S. Cl.
USPC ..... 297/461; 297/451.5; 297/451.4; 297/423.43

(58) Field of Classification Search
USPC ..... 297/461, 423.41, 423.43, 451.5, 451.4; D6/349, 351, 352
See application file for complete search history.

(56) References Cited

U.S. PATENT DOCUMENTS

| | | | | | |
|---|---|---|---|---|---|
| 2,038,806 | A | | 4/1936 | Sellar | |
| 2,552,693 | A | * | 5/1951 | Smith | 297/462 |
| 3,230,909 | A | * | 1/1966 | Watson | 108/150 |
| 3,230,910 | A | * | 1/1966 | Olssen | 297/461 |
| 3,312,437 | A | | 4/1967 | Barth | |
| D222,714 | S | * | 12/1971 | Bates | D6/358 |
| D222,715 | S | * | 12/1971 | Bates | D6/497 |
| 3,663,058 | A | * | 5/1972 | Hirsch | 297/423.41 |
| 3,694,030 | A | * | 9/1972 | Grosfillex | 297/448.1 |
| 4,208,072 | A | * | 6/1980 | Iskendarian | 297/440.1 |
| 5,044,587 | A | * | 9/1991 | Degen | 248/158 |
| 5,112,103 | A | | 5/1992 | Downer | |
| 5,746,481 | A | | 5/1998 | Obermaier | |
| 6,484,649 | B1 | * | 11/2002 | Wang | 108/158 |
| D523,251 | S | * | 6/2006 | Parpala | D6/352 |
| 7,108,330 | B2 | * | 9/2006 | Mizelle et al. | 297/452.57 |
| D535,828 | S | * | 1/2007 | Gasca Burges | D6/349 |
| D581,177 | S | * | 11/2008 | Auberger et al. | D6/349 |
| D585,201 | S | * | 1/2009 | Auberger et al. | D6/349 |
| 7,478,878 | B2 | * | 1/2009 | Oettinger | 297/271.5 |
| 8,262,160 | B2 | * | 9/2012 | Mafi et al. | 297/219.1 |
| 2005/0151403 | A1 | | 7/2005 | Volkman et al. | |
| 2007/0138850 | A1 | | 6/2007 | Oettinger | |

FOREIGN PATENT DOCUMENTS

| | | | |
|---|---|---|---|
| DE | 825144 | C | 12/1951 |
| DE | 29603988 | U1 | 6/1996 |
| JP | 2003024177 | A | 1/2003 |

* cited by examiner

*Primary Examiner* — David R Dunn
*Assistant Examiner* — Tania Abraham
(74) *Attorney, Agent, or Firm* — Laurence A. Greenberg; Werner H. Stemer; Ralph E. Locher

(57) ABSTRACT

An item of seating furniture contains a seat providing a seat surface, a generally circular foot panel positioning the item of seating furniture on a floor, and a central part, which connects the seat to the foot panel and of which a vertical center axis runs centrally through the foot panel. The foot panel is of at least partially convex configuration and that side of the foot panel which is directed toward the floor is configured, at least in part, as a non-slip surface. This creates an ergonomic item of seating furniture which stands in a stable state.

12 Claims, 4 Drawing Sheets

ITEM OF SEATING FURNITURE

CROSS-REFERENCE TO RELATED APPLICATION

This application claims the priority, under 35 U.S.C. §119 (e), of German patent application No. DE 20 2010 003 608.9 filed Mar. 15, 2010; the prior application is herewith incorporated by reference in its entirety.

BACKGROUND OF THE INVENTION

Field of the Invention

The invention relates to an item of seating furniture, in particular to an ergonomic item of seating furniture in the form of a stool.

Although sitting is less of a strain than standing, long periods of sitting still give rise to physical complaints, in particular in the region of the spinal column and there, in particular, in the region of the pelvis and lumbar vertebrae. It is known that active movement during sitting, as far as possible in many directions and many variations, is beneficial to the intravertebral disks and the latter thus remain elastic, the spinal column can be straightened, the muscles in the back can be strengthened and the like. During such movement, which takes place in particular in the region of the pelvis, it is nevertheless the case that the upper part of the body can be kept relatively still, in which case the seated individual can continue, for example, working at a desk.

In order to allow such active movement during sitting, various ergonomic items of seating furniture have already been proposed. In most cases, these items of seating furniture have a movably mounted seat and possibly, in addition, a movably mounted backrest. The mechanism for these movable bearing devices for the seat and backrest are usually relatively complex and complicated.

SUMMARY OF THE INVENTION

It is accordingly an object of the invention to provide an item of seating furniture, which overcome the above-mentioned disadvantages of the prior art methods and devices of this general type, which is an ergonomic item of seating furniture having straightforward construction.

According to a first aspect of the invention, the item of seating furniture according to the invention contains a seat, for providing a seat surface, and a generally circular foot panel, for positioning the item of seating furniture on a floor. The foot panel is of an at least partially convex configuration and that side of the foot panel which is directed toward the floor is configured, at least in part, as a non-slip surface. A central part connects the seat to the foot panel and of which the vertical center axis runs centrally through the foot panel.

The item of seating furniture has a seat, a foot panel and a central part and forms a stool of straightforward construction. The foot panel is of at least partially convex configuration, in which case the entire stool can tilt, swing and/or oscillate on the foot panel. The item of seating furniture itself may thus be of essentially rigid and thus straightforward construction, in particular there is no need for any complicated articulation or similar tilting mechanisms to be integrated therein. The foot panel, which is circular (as seen in plan view), allows the stool to tilt in all directions. In order for it to be possible to ensure that the user is seated safely, despite the item of seating furniture actually standing in an unstable state on the floor, that side of the foot panel which is directed toward the floor, i.e. that side of the foot panel which is directed away from the seat, is configured, at least in part, as a non-slip surface. It can thus be ensured that, even in the tilted state, the stool does not slip on the floor beneath the user.

The "non-slip surface" on that side of the foot panel which is directed toward the floor should give rise to static friction between the foot panel and the floor, at least in the loaded state of the item of seating furniture, in which case the item of seating furniture, even in the tilted state, remains in its stable position on the floor. This "non-slip surface" should be coordinated, if appropriate, with the type of floor which is to be expected (tiles, stone, parquet, carpet, etc.) and can be achieved by the type of material, the structure of the surface, by a coating of the surface and the like. The static-friction effect achieved by this "non-slip surface" should be present, in particular, in the loaded state of the item of seating furniture and at room temperature. That side of the foot panel which is directed toward the floor is provided, at least in part, preferably over the entire region of the convex curvature or even wholly, with this non-slip surface.

The "convex configuration" of the foot panel results in the foot panel being curved in the direction of the floor. In order to achieve a symmetrical tilting action for the item of seating furniture, the convexity should be provided essentially in the center of the foot panel. The convexity here need not necessarily extend over the entire foot panel, right up to the periphery thereof. It is conceivable, in principle, within the context of the invention, to have foot panels which are curved in full or only in part, foot panels with just a single curvature portion or with more than one curvature portions and the like.

In a preferred configuration of the invention, that side of the foot panel which is directed toward the floor is formed, at least in part, from a soft plastic material. For example, the foot panel may be a 2-component plastic-material molding of which the side which is directed toward the floor is formed, at least in part, from the soft plastic material. Examples of suitable "soft plastic materials" are elastomers and thermoplastics such as TPE, TPU and soft PVC. In addition to its high coefficient of static friction with the floor, the soft plastic material also has the advantage that, as a result of its elasticity, it does not have any adverse effects on the floor (i.e. for example it does not scratch the floor). The soft plastic material is provided, in particular, for the region of the non-slip surface of the foot panel.

In a further configuration of the invention, the foot panel projects radially beyond the central part, and the outside of this periphery of the foot panel is likewise formed from the soft plastic material. This means that the stool does not have any adverse effects on other objects when its foot panel strikes against them and also does not adversely affect the floor when it is lying on its side, is dragged at a slant over the floor and the like.

The soft plastic material on the foot panel, in addition, reduces the risk of pinching-related injuries for the user and other individuals.

In one configuration of the invention, that side of the foot panel which is directed toward the floor has a single convex curvature portion. In other words, the foot panel is configured generally in the form of a segment of a sphere. The convex curvature of the foot panel has, for example, a radius of curvature of at least approximately 40 cm, more preferably at least approximately 50 cm. The relatively large radius of curvature results in a relatively limited tilting extent, and this makes it possible to prevent the item of seating furniture from tilting over.

Furthermore, it is preferred if the seat, or at least the seat surface thereof, is of at least partially concave configuration.

The concavity of the seat provides a comfortable and—in particular in the tilted state of the item of seating furniture—a safe seat surface and also allows a plurality of stools to be stacked one upon the other, it being possible for the convex foot panel of one item of seating furniture to be accommodated safely in the concave seat of a further item of seating furniture without slipping. Moreover, the concave configuration of the seat allows stable positioning of the item of seating furniture on the floor in an inverted or upended state.

In one configuration of the invention, on its top side, which is directed away from the foot panel and/or the floor, the seat has at least one recess, into which a seat cushion is inserted. In this way, the seat surface can be produced from a different material than the seat, as a result of which the comfort of the seat can be increased. This recess of the seat is preferably spaced apart from the periphery of the seat, i.e. it does not extend over the entire seat, and it preferably has a depth equal to, or greater than, the thickness of the seat cushion. This makes it possible, for example, to prevent the situation where the seat cushion is removed by being scraped along floor edges or the like, if the item of seating furniture is dragged over the floor in an inverted (i.e. upended) state.

The seat is, for example, like the foot panel, of a generally circular configuration. It is preferred here if a diameter of the foot panel and a diameter of the seat are essentially equal in size. This embodiment improves the stacking capability of the items of seating furniture.

In a yet further configuration of the invention, on its underside, which is directed toward the foot panel and/or the floor, the seat is provided, at least in part, with a projecting periphery. This periphery allows the item of seating furniture to be gripped to good effect on its seat, both if the user is sitting on the item of seating furniture and for the purpose of carrying the item seating furniture. For this purpose, the periphery preferably has a thickness which is comfortable for holding purposes and is coordinated with the user of the appropriately sized item of seating furniture (child size, adult size, etc).

This periphery on the underside of the seat is preferably formed around the entire circumference, but it may also be provided only in part.

It is further advantageous if this periphery on the underside of the seat has a plurality of portions of different heights, for example of a wave-shaped configuration. This makes it easier to grip the item of seating furniture on its seat for carrying purposes and when the user is sitting thereon. Furthermore it is thus possible for adjacent items of seating furniture, during stacking, to be fitted one inside the other in a state in which they are inverted in relation to one another. The plurality of portions of different heights here may be optionally of uniform configuration or be variable.

Furthermore, the periphery on the underside of the seat may be directed, at least in part, radially outward. In this case, it is possible—depending on the configuration of the periphery—to prevent the situation where the item of seating furniture can be rolled when it is lying on its side.

In a yet further configuration of the invention, in its region which is directed toward the foot panel, the central part is of at least partially conical configuration. The conical region may serve, for example, for supporting a foot when the user is sitting, in order for it to be better possible for equilibrium to be maintained. The surface of the central part here is preferably at least partially of rough design, in order for it to be possible to provide a better grip.

According to a second aspect of the invention, the item of seating furniture according to the invention contains a seat, for providing a seat surface, a generally circular foot panel, for positioning the item of seating furniture on a floor, and a central part, which connects the seat to the foot panel and of which the vertical center axis runs centrally through the foot panel. The seat, or the seat surface thereof, here is of at least partially concave configuration, and that side of the foot panel which is directed toward the floor has a single convex curvature portion. The concavity of the seat provides a comfortable and—in particular in the tilted state of the item of seating furniture—safe seat surface and also allows a plurality of stools to be stacked one upon the other, it being possible for the convex foot panel of one item of seating furniture to be accommodated safely in the concave seat of a further item of seating furniture without slipping.

According to a third aspect of the invention, the item of seating furniture according to the invention contains a seat, for providing a seat surface, a generally circular foot panel, for positioning the item of seating furniture on a floor, wherein the foot panel is of at least partially convex configuration, and a central part, which connects the seat to the foot panel and of which the vertical center axis runs centrally through the foot panel. On its underside, which is directed toward the foot panel, the seat here is provided, at least in part, with a projecting periphery, which has a plurality of portions of different heights and is directed, at least in part, radially outward.

The periphery on the underside of the seat, this periphery having a plurality of portions of different heights, for example being of a wave-shaped configuration, makes it easier to grip the item of seating furniture on its seat for carrying purposes and when the user is sitting thereon. The plurality of the portions of different heights here may be optionally of uniform configuration or be variable. It is also possible for adjacent items of seating furniture, during stacking, to be fitted one inside the other in a state in which they are inverted in relation to one another. Furthermore, the at least partially radially outwardly directed periphery results in that the item of seating furniture cannot be rolled when it is lying on its side.

Other features which are considered as characteristic for the invention are set forth in the appended claims.

Although the invention is illustrated and described herein as embodied in an item of seating furniture, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
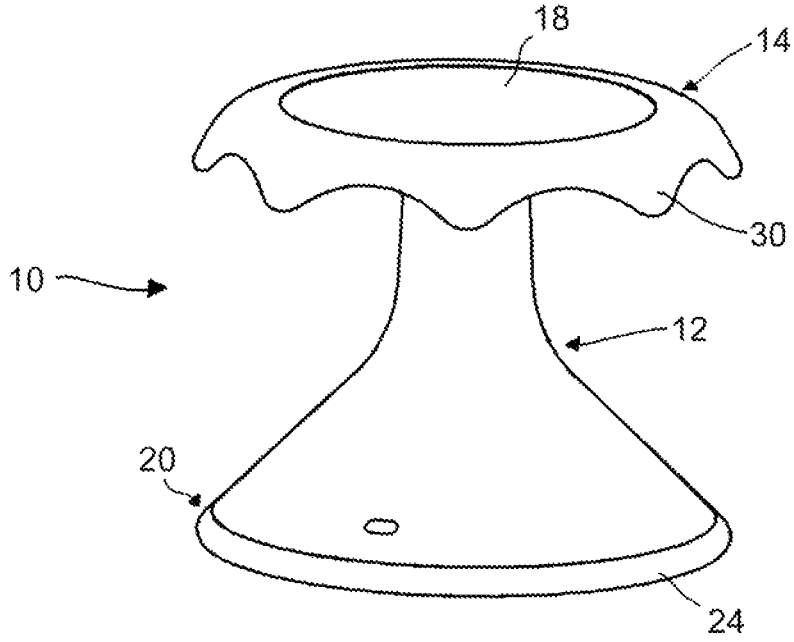
FIG. 1 is a diagrammatic, perspective view of an exemplary embodiment of an item of seating furniture according to the invention as seen obliquely from above.
Figure 2:
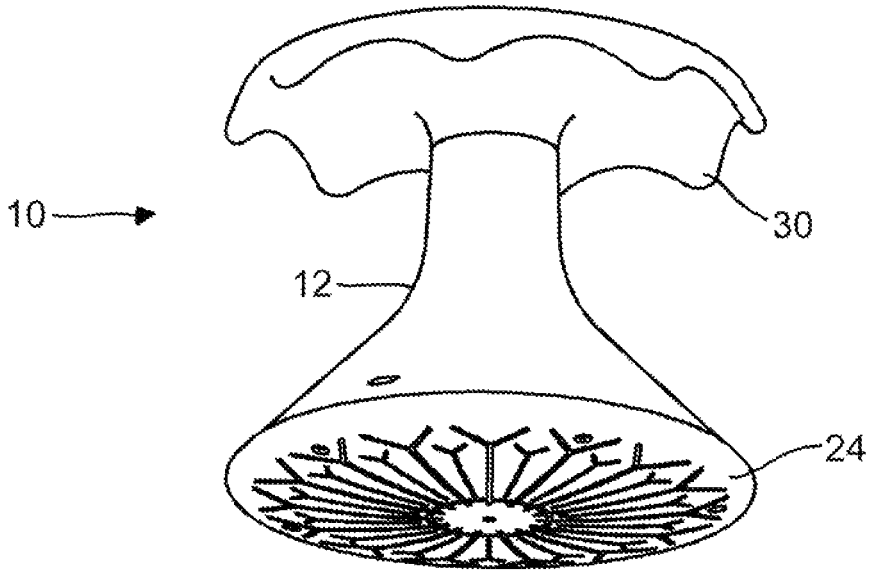
FIG. 2 is a diagrammatic, perspective view of the item of seating furniture from FIG. 1 as seen obliquely from beneath.
Figure 3:
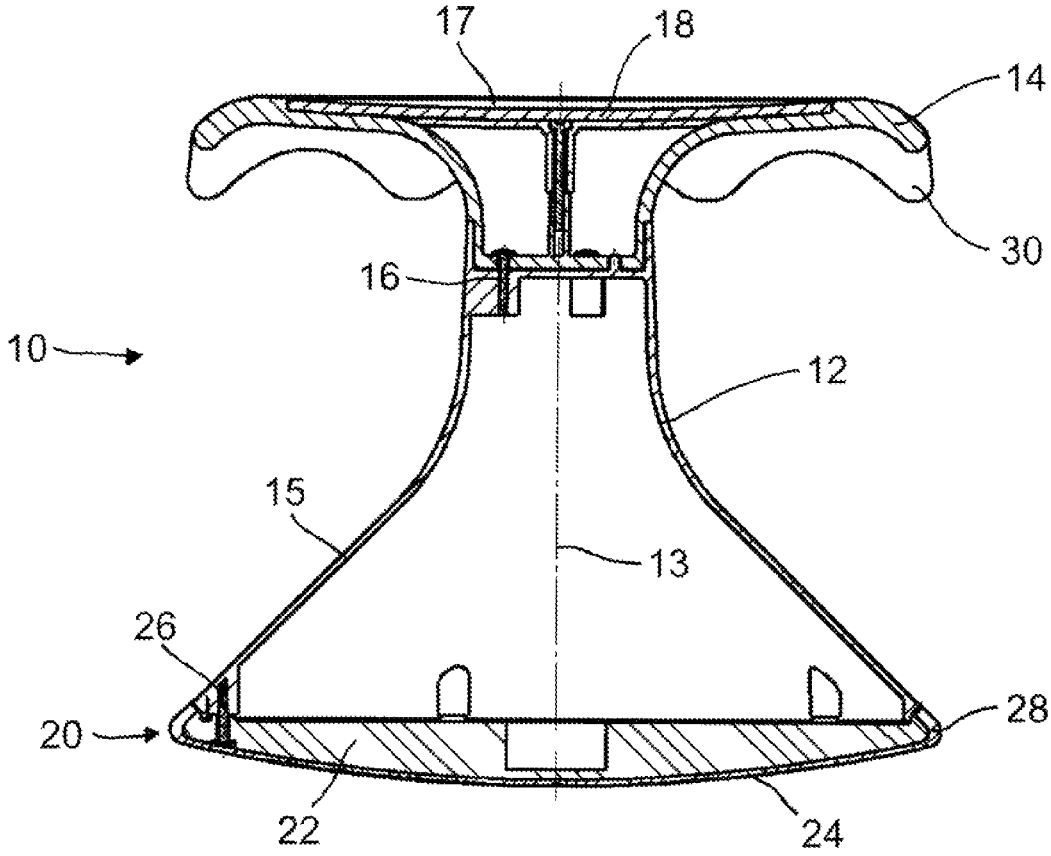
FIG. 3 a sectional, side view of the item of seating furniture shown in FIGS. 1 and 2.

FIGS. 1 to 3 will be used to explain in more detail, in the first instance, the construction and the ergonomics of a preferred exemplary embodiment of an item of seating furniture.

The three main constituent parts of a stool-like item of seating furniture 10 are a seat 14, a foot panel 20 and a central part 12, which connects the seat 14 to the foot panel 20. The item of seating furniture 10 is of a generally rotationally symmetrical configuration, as seen in plan view, i.e. both the seat 14 and the foot panel 20 are of a generally circular configuration and the central part 12 is arranged centrally, in which case a vertical center axis 13 of the central part 12 runs centrally through the foot panel 12 and through the seat 14.

The stool 10 can be produced in various sizes. For example, it is conceivable to have stools 10 with different heights of 31 cm, 38 cm and 46 cm and a respective diameter of approximately 32 cm. These values, however, are only by way of example.

As is illustrated in FIG. 3, the central part 12 is configured as a conical hollow body, of which the narrower region is directed toward the seat 14. The conical shape of the central part 12 gives rise to encircling flanks 15 which widen in the direction of the foot panel 20 and on which a user can support his/her foot or his/her feet when sitting. The outer surface of the central part 12 is advantageously of a rough texture, in order to provide a better grip for the user's feet supported thereon.

The central part is preferably produced as an injection molding made of a plastic material. Configuring the central part as a hollow part makes it possible to keep the weight of the item of seating furniture as a whole low, in which case it can easily be transported even by children.

The central part 12 may have provided on it, in addition, markings or identifying measures relating to, for example, the size, the type, the name and the like of the item of seating furniture. These markings are preferably recessed into the injection molding, and this makes it possible to prevent them from being released and lost from the item of seating furniture.

The seat 14 is likewise preferably produced as an injection molding from a plastic material and is fixedly connected to the central part by screws 16. As an alternative, an adhesive-bonding or clamping connection or a combined connecting method is also possible.

On the top side of the seat 14, the top side being directed away from the floor, the seat is provided with a central recess 17. The screws 16 for fastening the seat 14 on the central part 12 are accessible through the recess 17. Furthermore, a seat cushion 18, for example made of foam material (e.g. PE foam) or some other comfortable material, is inserted into the recess 17 of the seat 14. In addition, the seat cushion 18 can optionally have a cover which is removable (e.g. fastened by a touch-and-close fastener) and is thus interchangeable, and possibly washable. Of course, it is further possible for the seat cushion 18, or possibly the cover, also to be made, if desired, in a different color to the rest of the stool 10, and this gives rise to different design variations. The seat cushion 18 is fastened in the seat 14, for example, by adhesive bonding, clamping, press fitting and the like.

As can be seen in FIG. 3, the recess 17 in the top side of the seat 14 is of concave, i.e. inwardly curved, configuration, in which case the inserted seat cushion 18 also forms a concave seat surface in the top side of the seat 14. This concavity is advantageous for the user to be seated safely, in particular when a stool 10 is tilted. Moreover, when the stool 10 is inverted, the concave top side of the seat 14 forms a planar rest (see FIG. 4), on which the stool 10 can be supported in a safe and stable manner.

It can be seen in FIGS. 1 and 3 that the recess 17 and the seat cushion 18 do not extend right up to the periphery of the seat 14. The stool 10 can thus be inverted without the seat cushion 18 dragging on the floor and being removed by being scraped, for example, along a floor edge or the like. Moreover, the recess 17 is preferably deep enough for the seat cushion 18 which is inserted therein not to project, this avoiding the situation where the seat cushion 18 is damaged or removed by being scraped along the floor when the stool is being used, or when the inverted stool is being pushed over the floor.

On the underside of the seat 14, the underside being directed toward the floor, the seat, furthermore, is configured with an encircling periphery 30. This periphery extends generally in the direction of the foot panel 20, but is also inclined radially outward to some extent. In the exemplary embodiment of FIGS. 1 to 3, this periphery 30 of the seat is of a wave-shaped (e.g. of sine-wave-shaped) configuration, the waves having, for example, eight wave crests. It is likewise possible, however, to have other numbers of wave crests, other shapes for the periphery portions of different heights, differently dimensioned and/or shaped wave crests on an item of seating furniture and the like.

A user can use his/her hand to grip easily and comfortably around this periphery 30 on the underside of the seat 14. This is possible both when the user is sitting on the item of seating furniture 10 and for the purpose of carrying the same. The periphery 30 with round or rounded shapes is thus advantageous for comfortable gripping of the seat. The thickness of the periphery 30 here should be coordinated with the respective user, in order to permit comfortable gripping. Consequently, child-size stools 10 have, for example, a thinner periphery 30 than adult-size stools 10.

In addition to its function of a grip, the periphery 30 on the seat 14 also has a further advantage. If the entire seat 14 were of a precisely circular configuration, then the stool 10 would easily roll when lying on its side, and this could, for example, prove troublesome or even be dangerous. Since the periphery 30, however, is directed outward to some extent and has portions of different heights, the item of seating furniture 10 cannot roll away via the periphery 30.

At its end which is directed away from the abovedescribed seat 14, the central part 12 is connected to the already mentioned foot panel 20. The foot panel 20 is a body which is generally circular (as seen in plan view) and has a convex curvature, in other words is configured essentially in the form of a segment of a sphere, on the outside, which is directed toward the floor. Connection to the central part 12 takes place, for example, via screw connections 26, adhesive-bonding connections, press fitting or the like.

The convexity on the outside of the foot panel 20 is provided centrally and extends outwards preferably over the entire foot panel 20. This convexity of the foot panel 20 results in that the stool 10, when standing on foot panel 20, can be tilted in all directions, and this achieves actively dynamic sitting on the stool 10, with the known ergonomic advantages.

In order to prevent the stool 10 from tilting over altogether when a user is sitting, and moving, thereon, the convexity of the foot panel 20 is kept to a relatively low level, in order to limit the possible angle of inclination. The foot panel 20 is thus configured, for example, generally in the form of a segment of a circle of which the radius of curvature is at least approximately 40 cm, preferably at least 50 cm. The diameter of the foot panel 20 of, for example, approximately 32 cm thus gives rise to a height of curvature of, for example, not more than 3 to 4 cm.

Furthermore, it has to be ensured that the item of sitting furniture 10 does not slip beneath the user, in particular during tilting. For this purpose, the underside of the foot panel 20, the underside being directed toward the floor, is defined, at least in part, preferably in full, with a non-slip surface 24.

In a preferred configuration of the invention, the foot panel 20, which is in the form of a segment of a sphere, is produced as a 2-component injection molding. The inner, main body 22 here is produced, for example, from a hard plastic material, whereas the outside, which is directed toward the floor, is formed from a soft plastic material such as, for example, TPE (thermoplastic elastomers, with their various subgroups), TPU (thermoplastic polyurethane elastomers) or soft PVC. This soft plastic material forms the non-slip surface 24 since—in particular when the item of seating furniture is subjected to loading by a user—it has a large coefficient of static friction with the floor (e.g. tiles, stone, parquet, carpet) and thus prevents the foot panel 20 from slipping on the floor. In addition, the soft plastic material 24 does not have any adverse effects on the floor, even when the item of seating furniture is dragged over the floor. Furthermore, the configuration with the soft plastic material makes it possible to minimize the risks of pinching-related injuries for the user and other individuals.

In addition, the non-slip surface 24 of the foot panel 20 may be configured such that it repels dust, dirt, extraneous particles and the like or picks them up at least temporarily.

As is illustrated in FIG. 3, the foot panel 20 extends preferably radially beyond the central part 12, wherein the resulting periphery 28 of the foot panel 20 is likewise formed with the soft plastic material 24 on its outside. The soft plastic material 24 on the periphery 28 of the foot panel 20, on account of its elasticity, can prevent, or at least limit, damage to other objects against which the item of seating furniture 10 may strike.

In the exemplary embodiment of FIGS. 1 to 3, the convexity of the foot panel 20 is selected to be greater than the concavity of the seat 14 (in respect of diameter and depth). It is likewise possible, however, to have configurations of the stool 10 in which the convexity of the foot panel 20 is selected to be approximately equal to, or smaller than, the concavity of the seat 14.

Figure 4:
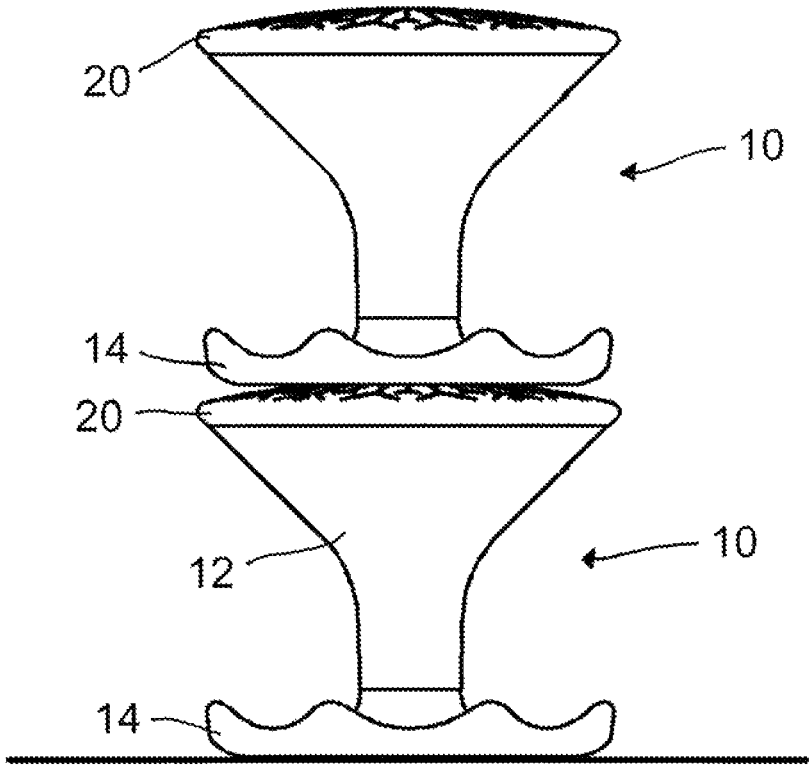
FIG. 4 is a diagrammatic, side view of two items of seating furniture from FIGS. 1 and 2 stacked one upon the other.
Figure 5:
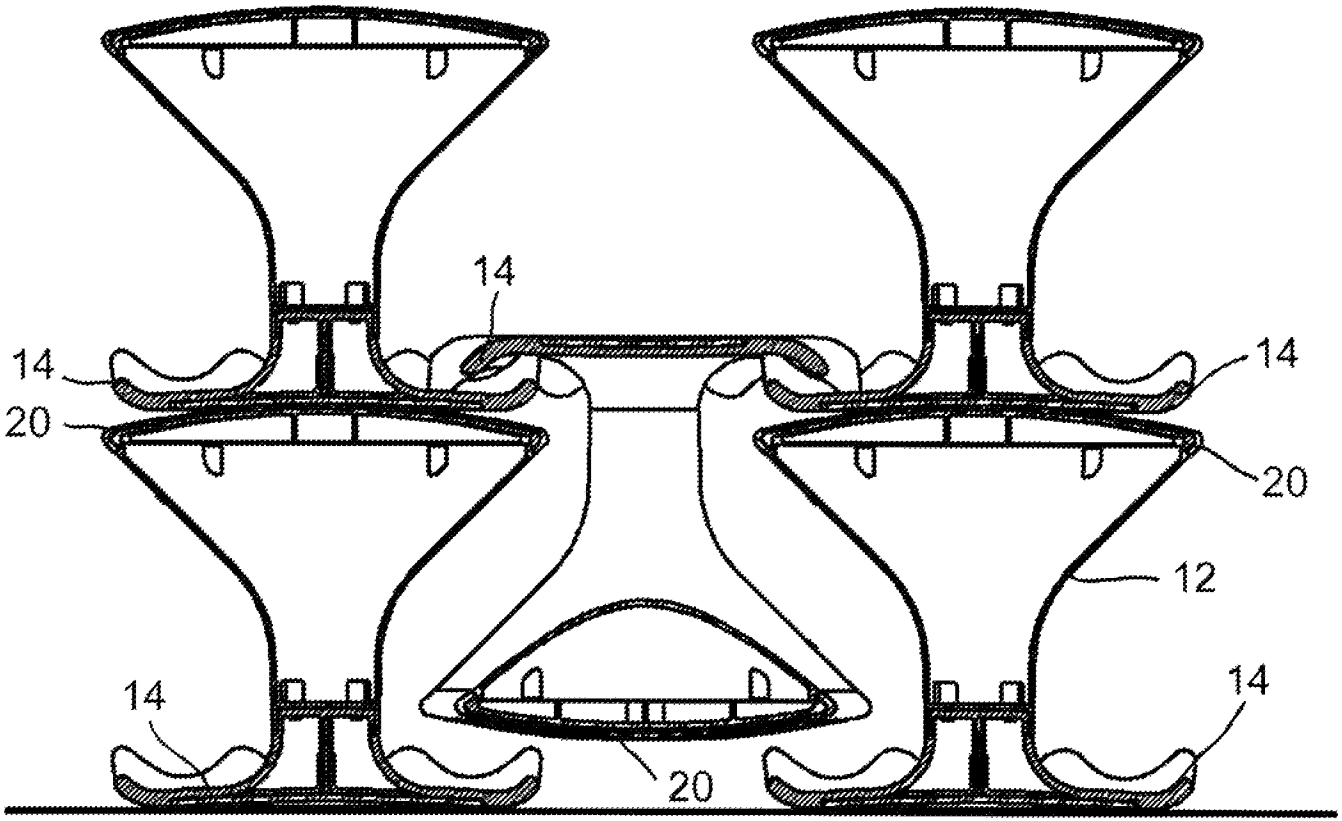
FIG. 5 is a diagrammatic, sectional side view of five items of seating furniture from FIGS. 1 and 2 stacked one upon the other and one inside the other.

FIGS. 4 and 5 will now be used to demonstrate how the abovedescribed items of seating furniture 10 can advantageously be stacked.

As has already been mentioned above, the top side of the seat 14, the top side being directed away from the floor, forms, on account of its concavity, a planar rest when the item of seating furniture 10 is positioned in an inverted state on the floor. Such an inverted stool 10 can then have a second stool 10 stacked on it—likewise in an inverted state. Since the convex curvature of the foot panel 20 of the bottom stool 10 engages, at least in part, in the concave surface of the seat 14 of the top stool 10, this gives rise to a relatively stable stack of items of seating furniture 10, in which case these can be stored, cleared away and transported in a space-saving manner.

The specially configured periphery 30 on the underside of the seat 10, in addition, allows these items of seating furniture 10 to be stacked in an even more compact manner, as will be explained hereinbelow.

As is demonstrated in FIG. 5, two stacks of items of seating furniture 10 stacked one above the other as described above can have a further stool 10 fitted between them. For this purpose, the fifth stool 10, rather than being inverted, is fitted in its use position, by way of the downwardly projecting periphery 30 on its seat 14, into the upwardly projecting peripheries 30 of the seats 14 of the respectively top stools 10 of the adjacent stacks.

In order to achieve a stable stack and stable fitting, it is advantageous if, rather than a respective periphery 30 merely being present on the underside of the item of seating furniture 10, this periphery 30 additionally has portions of different heights (e.g. in wave form, as illustrated), and this therefore also means that the fifth stool 10 fitted in cannot turn.

It can be seen from FIG. 5 that the fifth stool 10 can be fitted in between two row-formed stacks of inverted stools 10. An even more stable assembly can be achieved if this additional stool 10 is fitted in centrally between a plurality of (three, four or five) stacks of inverted stools 10.

While FIG. 5 shows two stacks of in each case two stools 10 stacked one above the other with a further stool 10 fitted in, it is also of course possible for the items of seating furniture 10 according to the invention to be arranged in more than two stacks, to be stacked one upon the other using more than two stools 10, in the last-mentioned case also for the plurality of stools 10 to be fitted in one above the other between the adjacent stacks, and the like.

The advantages of the stool-like item of seating furniture of the invention are, in particular:

a) ergonomic seating, as a result of it being possible for the item of seating furniture to be tilted in all directions on account of the convexity of the foot panel;
b) safe tilting of the item of seating furniture, since the non-slip surface on the foot panel results in that the item cannot slip and the limited convexity of the foot panel results in that the item can tilt only to a limited extent;
c) comfortable seating, as a result of the seat cushion and the concavely shaped surface of the seat;
d) straightforward and comfortable gripping of the item of seating furniture, both when the user is sitting thereon and for carrying purposes, as a result of the periphery on the underside of the seat;
e) safe support of the item of seating furniture in the inverted state, as a result of the concavity of the seat and thus of the planar rest;
f) no rolling away of the item of seating furniture when it is lying on its sides, as a result of the radially outwardly directed periphery on the underside of the seat and of the periphery portions of different heights;
g) stacking capability of the items of seating furniture, as a result of the concave top side of the seat;
h) ability for the items of seating furniture to be stacked in a compact manner, as a result of the radially outwardly directed periphery on the underside of the seat and of the periphery portions of different heights;
i) no adverse effects on the floor, as a result of the soft plastic material of the non-slip surface of the foot panel; and
j) no adverse effects on other objects, as a result of the outer periphery of the foot panel with its soft plastic material.

The invention claimed is:

1. An item of seating furniture, comprising:

a seat having a seat surface;

a generally circular foot panel for positioning the item of seating furniture on a floor, said generally circular foot panel having a side directed toward the floor being configured, at least in part, as a non-slip surface, and having a single convex curvature portion being provided centrally and extending outwards over said foot panel entirely such that said foot panel is configured in a form of a segment of a sphere on an outer side directed to the floor to achieve a symmetrical tilting action for the item of seating furniture;

a central part connecting said seat to said generally circular foot panel, said central part having a vertical center axis running centrally through said generally circular foot panel;

said seat having a top side facing away from said generally circular foot panel, said top side having at least one recess formed therein and a periphery around said recess lying within a single horizontal plane; and said seat having an underside directed toward said generally circular foot panel, and on said underside, said seat having, at least in part, a projecting periphery extending from said periphery and having a plurality of portions of different heights relative to said periphery of said top side of said seat and being directed, at least in part, radially outward to prevent the item of seating furniture from rolling away via said projecting periphery when lying on a side, said projecting periphery on said underside of said seat being of a periodic wave-shaped design.

2. The item of seating furniture according to claim 1, wherein said side of said generally circular foot panel which is directed toward the floor is formed, at least in part, from a soft plastic material.

3. The item of seating furniture according to claim 2, wherein said generally circular foot panel is a 2-component plastic-material molding of which said side which is directed toward the floor is formed, at least in part, from said soft plastic material.

4. The item of seating furniture according to claim 2, wherein said generally circular foot panel projects radially beyond said central part, and an outside of a periphery of said generally circular foot panel is formed from said soft plastic material.

5. The item of seating furniture according to claim 1, wherein one of said seat or said seat surface has at least a partially concave configuration.

6. The item of seating furniture according to claim 1, further comprising a seat cushion; and wherein said seat cushion is inserted in said recess on said top side.

7. The item of seating furniture according to claim 6, wherein said recess of said seat is spaced apart from said periphery of said seat.

8. The item of seating furniture according to claim 6, wherein said recess has a depth equal to, or greater than, a thickness of said seat cushion.

9. The item of seating furniture according to claim 1, wherein said seat has a generally circular design.

10. The item of seating furniture according to claim 1, wherein a diameter of said generally circular foot panel and a diameter of said seat are approximately equal in size.

11. The item of seating furniture according to claim 1, wherein said projecting periphery on said underside of said seat is formed around an entire circumference.

12. The item of seating furniture according to claim 1, wherein said central part has a region directed toward said generally circular foot panel, and said region is of at least a partially conical configuration.

* * * * *